US009790899B2

(12) United States Patent
Mack et al.

(10) Patent No.: US 9,790,899 B2
(45) Date of Patent: Oct. 17, 2017

(54) EGR COOLING SYSTEM

(71) Applicant: Cummins, Inc., Columbus, IN (US)

(72) Inventors: Thomas Lee Mack, Columbus, IN (US); Long K. Hwang, Columbus, IN (US)

(73) Assignee: Cummins Inc., Columbus, IN (US)

( * ) Notice: Subject to any disclaimer, the term of this patent is extended or adjusted under 35 U.S.C. 154(b) by 839 days.

(21) Appl. No.: 14/268,522

(22) Filed: May 2, 2014

(65) Prior Publication Data

US 2015/0316006 A1 Nov. 5, 2015

(51) Int. Cl.

*F02M 25/07* (2006.01)
*F02M 26/32* (2016.01)
*F02M 26/25* (2016.01)

(52) U.S. Cl.

CPC ..... *F02M 26/32* (2016.02); *F02M 25/0726* (2013.01); *F02M 26/25* (2016.02)

(58) Field of Classification Search

CPC ..... F02M 26/32; F02M 26/25; F02M 25/0726
USPC ..... 123/568.12
See application file for complete search history.

(56) References Cited

U.S. PATENT DOCUMENTS 6,976,530 B2 12/2005 Hayashi et al.
7,213,639 B2 5/2007 Danielsson et al.
7,594,536 B2 * 9/2009 Sugihara ..... F28D 7/16 123/568.12
2003/0111210 A1 * 6/2003 Tsujita ..... F28D 7/1653 165/51
2004/0107949 A1 * 6/2004 Miyoshi ..... F02M 26/57 123/568.12
2004/0206342 A1 * 10/2004 Moyer ..... F02M 26/26 123/568.12
2005/0188965 A1 9/2005 Usui
2006/0090880 A1 * 5/2006 Sugihara ..... F28D 7/16 165/103
2006/0231243 A1 10/2006 Sugihara et al.

* cited by examiner

*Primary Examiner* — Hung Q Nguyen
(74) *Attorney, Agent, or Firm* — Foley & Lardner LLP

(57) ABSTRACT

An exhaust gas cooler and method of cooling are provided. The exhaust gas cooler includes an inlet and outlet manifold and respectively including inlet and outlet openings and respectively positioned at a first and second end of the cooler. The exhaust gas cooler includes a plurality of conduits coupled to the inlet and outlet manifold and also includes at least one side wall coupled to the inlet and outlet manifold around the plurality of conduits, such that the plurality of conduits are disposed in a region between the at least one side wall and the inlet and outlet manifold. The at least one sidewall includes a first coolant inlet opening and a first coolant outlet opening each adjacent a first end of the exhaust gas cooler, a second coolant inlet opening, and a second coolant outlet opening. The exhaust gas cooler includes a bypass conduit positioned outside of the region.

29 Claims, 3 Drawing Sheets

EGR COOLING SYSTEM

TECHNICAL FIELD

This disclosure relates to a system for cooling exhaust gas recirculation (EGR) in an internal combustion engine.

BACKGROUND

Exhaust gas may be recirculated in an internal combustion engine to improve the emissions of the engine. Cooling recirculated exhaust gas improves the emissions of the engine as well as the fuel economy of the engine. The high temperatures achieved by exhaust gas may cause an EGR cooling system to fail. Any such failures may be exacerbated at the hot end of the EGR cooling system in light of the extreme temperatures and temperature gradients experienced thereby.

SUMMARY

Various embodiments provide systems and methods of cooling EGR. In particular embodiments, an exhaust gas cooler for cooling recirculating exhaust gas is provided. The exhaust gas cooler includes an inlet manifold positioned at a first end of the exhaust gas cooler. The inlet manifold includes a plurality of exhaust gas inlet openings. The exhaust gas cooler also includes an outlet manifold positioned at a second end of the exhaust gas cooler. The outlet manifold includes a plurality of exhaust gas outlet openings. The exhaust gas cooler includes a plurality of conduits coupled to the inlet manifold and the outlet manifold. Each conduit in the plurality of conduits extends from an exhaust gas inlet opening of the plurality of exhaust gas inlet openings in the inlet manifold to an exhaust gas outlet opening of the plurality of exhaust gas outlet openings in the outlet manifold. The exhaust gas cooler includes at least one side wall coupled to the outlet manifold and the inlet manifold around the plurality of conduits, such that the plurality of conduits are disposed in a region between the at least one side wall, the inlet manifold, and the outlet manifold. The at least one sidewall includes a first coolant inlet opening adjacent the first end of the exhaust gas cooler, a first coolant outlet opening adjacent the first end of the exhaust gas cooler, a second coolant inlet opening, and a second coolant outlet opening. The exhaust gas cooler also includes a bypass conduit positioned outside of the region. The bypass conduit fluidly couples the first coolant outlet opening to the second coolant inlet opening, such that at least a part of a coolant flowing into the region adjacent the first end of the exhaust gas cooler and between the plurality of conduits flows out of the region adjacent the first end via the first coolant outlet opening, through the bypass conduit, and back into the region via the second coolant inlet opening.

In particular embodiments, the first coolant inlet opening is substantially opposite the first coolant outlet opening. The first end may be substantially opposite the second end. In particular embodiments, the second coolant inlet opening in the side wall is adjacent the second end. The second coolant outlet opening in the side wall is adjacent the second end, in accordance with particular embodiments. Each conduit in the plurality of conduits may be substantially parallel the other conduits in the plurality of conduits. The bypass conduit may be configured to provide a coolant flow path substantially parallel to the plurality of conduits. In particular embodiments, the second coolant inlet opening is substantially opposite the second coolant outlet opening. The inlet manifold includes a first flange and the outlet manifold includes a second flange, in accordance with particular embodiments. In particular embodiments, the exhaust gas cooler includes a vent positioned in the bypass conduit. The first coolant outlet opening is directly coupled to the second coolant inlet opening via the bypass conduit, in accordance with particular embodiments. The first coolant inlet opening and the first coolant outlet opening may be substantially orthogonal to the plurality of conduits. In particular embodiments, the exhaust gas cooler also includes a first coolant conduit outside of the region and fluidly coupled to the first coolant inlet opening and second coolant conduit outside of the region and fluidly coupled to the second coolant outlet. In particular embodiments, the bypass conduit is configured to bypass 25% of the coolant flowing into the first coolant inlet. Each conduit in the plurality of conduits may extend into the exhaust inlet opening of the plurality of exhaust inlet openings and into the exhaust outlet opening of the plurality of exhaust outlet openings. Each conduit in the plurality of conduits may extend through the exhaust inlet opening of the plurality of exhaust inlet openings and through the exhaust outlet opening of the plurality of exhaust outlet openings. Each conduit in the plurality of conduits may extend into the exhaust inlet opening of the plurality of exhaust inlet openings and into the exhaust outlet opening of the plurality of exhaust outlet openings.

Other various embodiments provide a method of cooling recirculating exhaust gas via an exhaust gas cooler. The method includes causing exhaust gas to flow into an inlet manifold positioned at a first end of the exhaust gas cooler and out of an outlet manifold positioned at a second end of the exhaust gas cooler. The exhaust gas is transmitted from the inlet manifold to the outlet manifold via a plurality of conduits coupled to the inlet manifold and the outlet manifold. Each conduit in the plurality of conduits extends from an exhaust gas inlet opening of the plurality of exhaust gas inlet openings in the inlet manifold to an exhaust gas outlet opening of the plurality of exhaust gas outlet openings in the outlet manifold. The coolant flows into a region between at least one side wall coupled to the outlet manifold and the inlet manifold around the plurality of conduits. The coolant flows into the region via a first coolant inlet opening in the at least one side wall. The first coolant inlet opening is adjacent the first end of the exhaust gas cooler. At least a portion of the coolant flows out of the region via a first coolant outlet opening adjacent the first end of the exhaust gas cooler. At least a portion of the coolant flows back into the region via a bypass conduit fluidly coupling the first coolant outlet opening to a second coolant inlet opening in the at least one side wall. The coolant flows out of the region via a second coolant outlet opening in the at least one side wall, whereby heat is convectively transferred from exhaust gas flowing through the plurality of conduits to coolant flowing through the region.

In particular embodiments, the method also includes causing gas to vent from the bypass conduit via a vent disposed therein. The first coolant outlet opening is directly coupled to the second coolant inlet opening via the bypass conduit, in accordance with particular embodiments.

Other various embodiments provide an engine system for cooling recirculating exhaust gas. The engine system includes an engine, an exhaust manifold configured to receive exhaust from at least one cylinder of the engine, and an exhaust gas cooler. The exhaust gas cooler includes an inlet manifold positioned at a first end of the exhaust gas cooler. The inlet manifold includes a plurality of exhaust gas inlet openings. The exhaust gas cooler also includes an outlet manifold positioned at a second end of the exhaust gas cooler. The outlet manifold includes a plurality of exhaust gas outlet openings. The exhaust gas cooler includes a plurality of conduits coupled to the inlet manifold and the outlet manifold. Each conduit in the plurality of conduits extends from an exhaust gas inlet opening of the plurality of exhaust gas inlet openings in the inlet manifold to an exhaust gas outlet opening of the plurality of exhaust gas outlet openings in the outlet manifold. The exhaust gas cooler includes at least one side wall coupled to the outlet manifold and the inlet manifold around the plurality of conduits, such that the plurality of conduits are disposed in a region between the at least one side wall, the inlet manifold, and the outlet manifold. The at least one sidewall includes a first coolant inlet opening adjacent the first end of the exhaust gas cooler, a first coolant outlet opening adjacent the first end of the exhaust gas cooler, a second coolant inlet opening, and a second coolant outlet opening. The exhaust gas cooler also includes a bypass conduit positioned outside of the region. The bypass conduit fluidly couples the first coolant outlet opening to the second coolant inlet opening, such that at least a part of a coolant flowing into the region adjacent the first end of the exhaust gas cooler and between the plurality of conduits flows out of the region adjacent the first end via the first coolant outlet opening, through the bypass conduit, and back into the region via the second coolant inlet opening. The engine also includes an intake manifold configured to provide intake air into the at least one cylinder, wherein the exhaust gas cooler is coupled to the exhaust manifold via the inlet manifold of the exhaust gas cooler and wherein exhaust gas cooler is coupled to the intake manifold via the outlet manifold of the exhaust gas cooler.

In particular embodiments, the first coolant inlet opening is substantially opposite the first coolant outlet opening. The first coolant outlet opening is directly coupled to the second coolant inlet opening via the bypass conduit, in accordance with particular embodiments. The second coolant inlet opening in the side wall may be adjacent the second end. The bypass conduit may be configured to provide a coolant flow path substantially parallel to the plurality of conduits. In particular embodiments, the second coolant inlet opening is substantially opposite the second coolant outlet opening. The engine system also a vent positioned in the bypass conduit, in accordance with particular embodiments. In particular embodiments, the bypass conduit is configured to bypass 25% of the coolant flowing into the first coolant inlet opening.

In other particular embodiments, an exhaust gas cooler for cooling recirculating exhaust gas is provided. The exhaust gas cooler includes exhaust gas flow means for causing exhaust gas to flow into an inlet manifold at a first end of the exhaust gas cooler and out of an outlet manifold at a second end of the exhaust gas cooler. The exhaust gas flow means is further configured for transmitting the exhaust gas from the inlet manifold to the outlet manifold in a plurality of distinct flow paths. The exhaust gas cooler also includes at least one side wall coupled to the outlet manifold and the inlet manifold about the plurality of distinct flow paths. The exhaust gas cooler includes coolant flow entry means for causing coolant to flow into a region within the at least one side wall adjacent the first end of the exhaust gas cooler. The exhaust gas cooler further includes bypass means for causing at least a portion of the coolant to flow out of the region adjacent the first end of the exhaust gas cooler and for causing the at least a portion of the coolant to flow back into the region. The exhaust gas cooler includes coolant flow exit means for causing the coolant to flow out of the region, whereby heat is convectively transferred from exhaust gas in the plurality of distinct flow paths to coolant flowing into and out of the region.

The inventors have appreciated that recirculated exhaust gas may be more effectively cooled using a split coolant flow that increases distribution and accommodates gas expansion and coolant re-entrainment. Accordingly, the inventors have further appreciated that the implementation and use of various embodiments disclosed herein may result in beneficial EGR cooling systems and methods that increase reliability and decrease EGR cooling system failures. It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

The skilled artisan will understand that the drawings primarily are for illustrative purposes and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

The features and advantages of the inventive concepts disclosed herein will become more apparent from the detailed description set forth below when taken in conjunction with the drawings.

DETAILED DESCRIPTION

Following below are more detailed descriptions of various concepts related to, and embodiments of, inventive systems, and methods of cooling EGR. It should be appreciated that various concepts introduced above and discussed in greater detail below may be implemented in any of numerous ways, as the disclosed concepts are not limited to any particular manner of implementation. Examples of specific implementations and applications are provided primarily for illustrative purposes.

Figure 1:
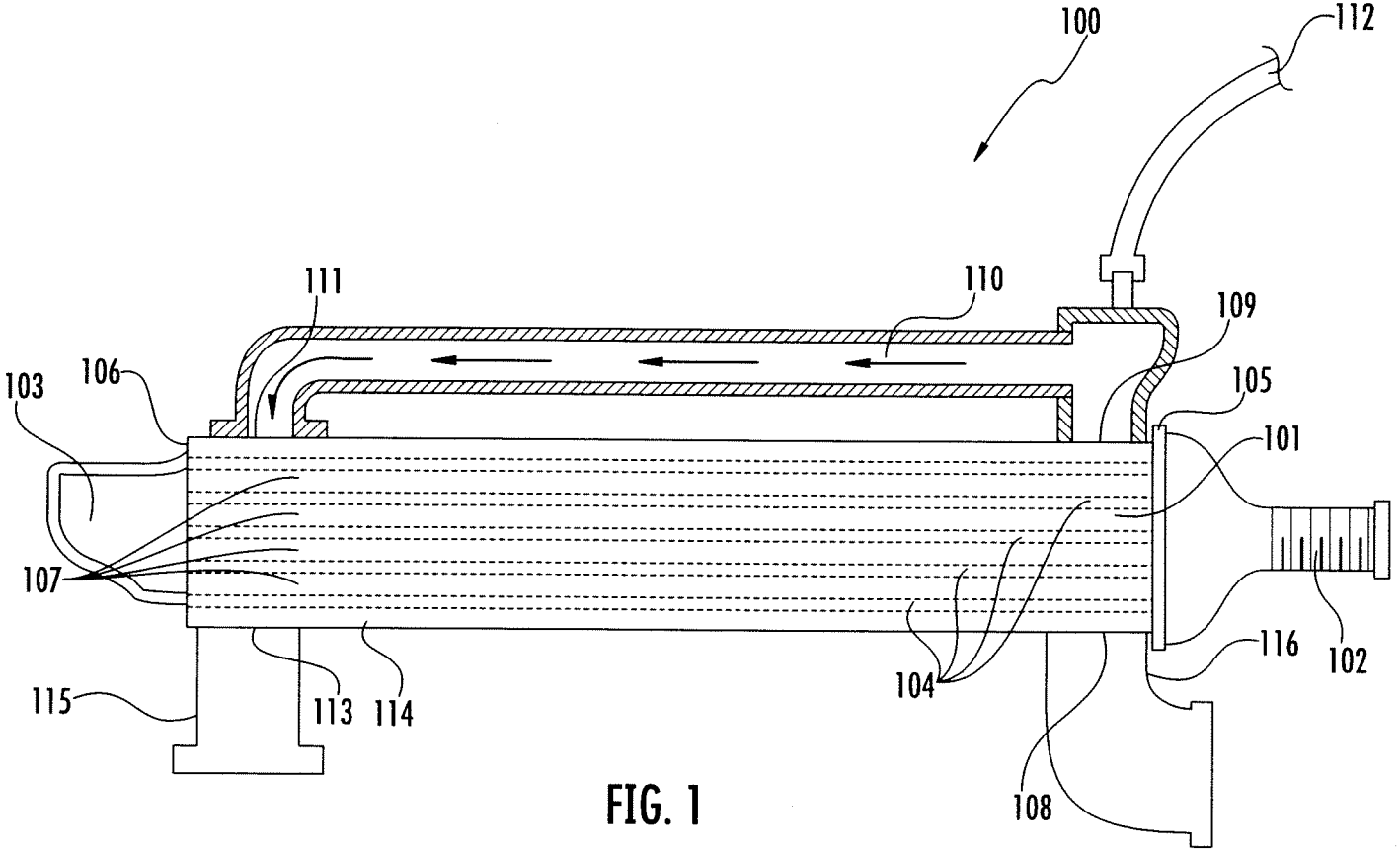
FIG. 1 shows a side view of an exhaust gas cooler for cooling EGR in accordance with example embodiments.

FIG. 1 shows a side view of an exhaust gas cooler for cooling recirculated exhaust gas in accordance with example embodiments. Exhaust gas cooler 101 includes an EGR inlet manifold 102 disposed at a first end, the hot end, of the exhaust gas cooler 101. The EGR inlet manifold 102 is configured to receive exhaust gas, for example from an exhaust component extending from an exhaust manifold coupled to an engine. The exhaust gas cooler 101 also includes an EGR outlet manifold 103 disposed at a second end, the cool end, of the exhaust gas cooler 101 opposite the first end. The EGR outlet manifold 103 is fluidly coupled to the EGR inlet manifold 102 via a plurality of conduits 104 extending from the first end of the exhaust gas cooler 101 to the second of the exhaust gas cooler 101. The plurality of conduits 104 may be coupled to the EGR inlet manifold 102 and the EGR outlet manifold 103 respectively via an inlet manifold endplate 105 including a plurality of exhaust gas inlet openings and an outlet manifold endplate 106 including a plurality of exhaust gas outlet openings. The end plate 101 and the conduits 104 are intricately coupled via a suitable manufacturing method, including, but not limited to, brazing and welding. One or more of the EGR inlet manifold 102 and the EGR outlet manifold 103 may include a flanged connector and may be configured as a straight conduit or a conduit having a bend to change the direction of flow of the recirculating exhaust gas.

The plurality of conduits 104 provide separate pathways for exhaust gas entering the EGR inlet manifold 102 to reach the EGR outlet manifold 103 while traveling through a heat exchanging medium. The plurality of conduits 104 are separated from one another such that a region 107 is formed between the conduits and at least one side wall 114 of the exhaust gas cooler 101. The region 107 is configured to receive coolant therein for convective heat transfer of heat from exhaust gas flowing through the plurality of conduits 104 to the coolant disposed in the region 107. Accordingly, the region 107 is separated or fluidly decoupled from interiors of the plurality of conduits 104 where the exhaust gas being recirculated flows.

Coolant is permitted to enter the region 107 via a first (and primary) coolant inlet opening 108 positioned in the sidewall 114 of the exhaust gas cooler 101. The first coolant inlet opening 108 transfers coolant, for example, flowing from a cooling system such as an engine radiator via a device such as a coolant pump, into the exhaust gas cooler 101 and more specifically into the region 107 within the exhaust gas cooler 101 for convectively cooling the exhaust gas flowing through the plurality of conduits 104 in the exhaust gas cooler 101. In an example embodiment, the first coolant inlet opening 108 may be configured to receive 70% of the coolant flow from the engine. The first coolant inlet opening 108 may be configured to introduce coolant substantially orthogonal to a longitudinal direction of extension of the plurality of conduits 104. The first coolant inlet opening 108 is fluidly connected to the region 107 via an opening in the side wall 114 of exhaust gas cooler 101.

The exhaust gas cooler 101 also includes a first coolant outlet opening 109. The first coolant outlet opening 109 is adjacent the first end or the hot end of the exhaust gas cooler 101. The first coolant outlet opening 109 is in fluid communication with the region 107 via an opening the side wall 114 of exhaust gas cooler 101. The first coolant outlet opening 109 is substantially opposite the first coolant inlet opening 108. In example embodiments, the first coolant outlet opening 109 may be slightly offset from the first coolant inlet opening 108 for example slightly rearward or forward the first coolant inlet opening 108. The first coolant outlet opening 109 is configured to permit a portion of the coolant to bypass a portion of the plurality of conduits 104 after traversing a hot end of the plurality of conduits 104 to reach the first coolant outlet opening 109. Accordingly, a dedicated portion of the coolant entering the exhaust gas cooler 101 via the first coolant inlet opening 108 is used primarily for hot side cooling. This dedicated portion also drives a significant coolant flow to traverse the hot side of the plurality of conduits in the exhaust gas cooler. The coolant flow traversing the hot side of the plurality of conduits also traverse the joint between the plurality of conduits 104 and the inlet manifold endplate 105 to reduce failures occurring at this interface. The remaining coolant introduced via the first coolant inlet opening 108 and not exiting via the first coolant outlet opening 109 provides the main function of cooling the exhaust gas flowing in the plurality of conduits 104 by flowing within the region 107 along and about the plurality of conduits 104.

The first coolant inlet opening 108 may have a larger cross sectional area than the first coolant outlet opening 109 to cause a particular volume of coolant to flow transversely across the plurality of conduits 104. For example, if the first coolant inlet opening 108 is receiving 70% of the volume of coolant flowing from the engine, the first coolant outlet opening 109 may be sized to receive 20% of the coolant flowing from the engine, while the remaining 50% of the coolant flowing through the outlet from the engine flows along the plurality of conduits 104 before exiting the manifold via a second coolant outlet opening 113. The second coolant outlet opening 113 may be coupled to an outflow coolant conduit 115, which may include a flanged coupling.

The coolant entering the first coolant outlet opening 109 bypasses a portion of the plurality of conduits 104, but is re-entrained into the region 107 via the second coolant inlet opening 111, fluidly coupled to the first coolant outlet opening 109 via a bypass conduit 110. The bypass conduit 110 may directly couple the first coolant outlet opening 109 to the second coolant inlet opening 111 and may thereby produce a coolant flow path that is substantially parallel to the fluid flowing longitudinally along the plurality of conduits 104 via the region 107. In addition to inducing coolant flow across the hot side of the plurality of conduits 104 at the interface of the plurality of conduits 104 and the inlet manifold endplate 105, the bypass conduit 110 permits air, steam, bubbles, or any other form of gas that might form or accumulate at or near the interface of the plurality of conduits 104 and inlet manifold endplate 105 to be purged and re-entrained into coolant. In example embodiments, the bypass conduit 110, the first coolant outlet opening 109, and the second coolant inlet opening 111 may be an integral structure. In the illustrated embodiment, the second coolant inlet opening 111 is positioned adjacent the second end. In other embodiments, however, the second coolant inlet opening 111 may be intermediate the second end and the first end of the exhaust gas cooler 101, thereby introducing the coolant flowing through the bypass conduit 110 to be re-entrained into the remaining coolant in the region 107 at a point intermediate the first and second end of the exhaust gas cooler 101. After the coolant flow flowing through the bypass conduit 110 has been re-entrained into the remaining coolant in the region 107, the coolant is permitted to exit the exhaust gas cooler 101 and the region 107 via the second (and primary) coolant outlet 113. In particular embodiments, the bypass conduit 110 directly couples the bypass flow to the outflow coolant conduit 115 or a point downstream in the coolant system. This may aid to balance system restrictions and achieve the desired bypass flow through bypass conduit 110. In example embodiments, the bypass conduit 110 may include a vent 112 near the hot end for evacuating gas during the initial cooling system filling and additionally for evacuating any significant accumulation of gases in the cooling system during cooling operation.

Figure 2:
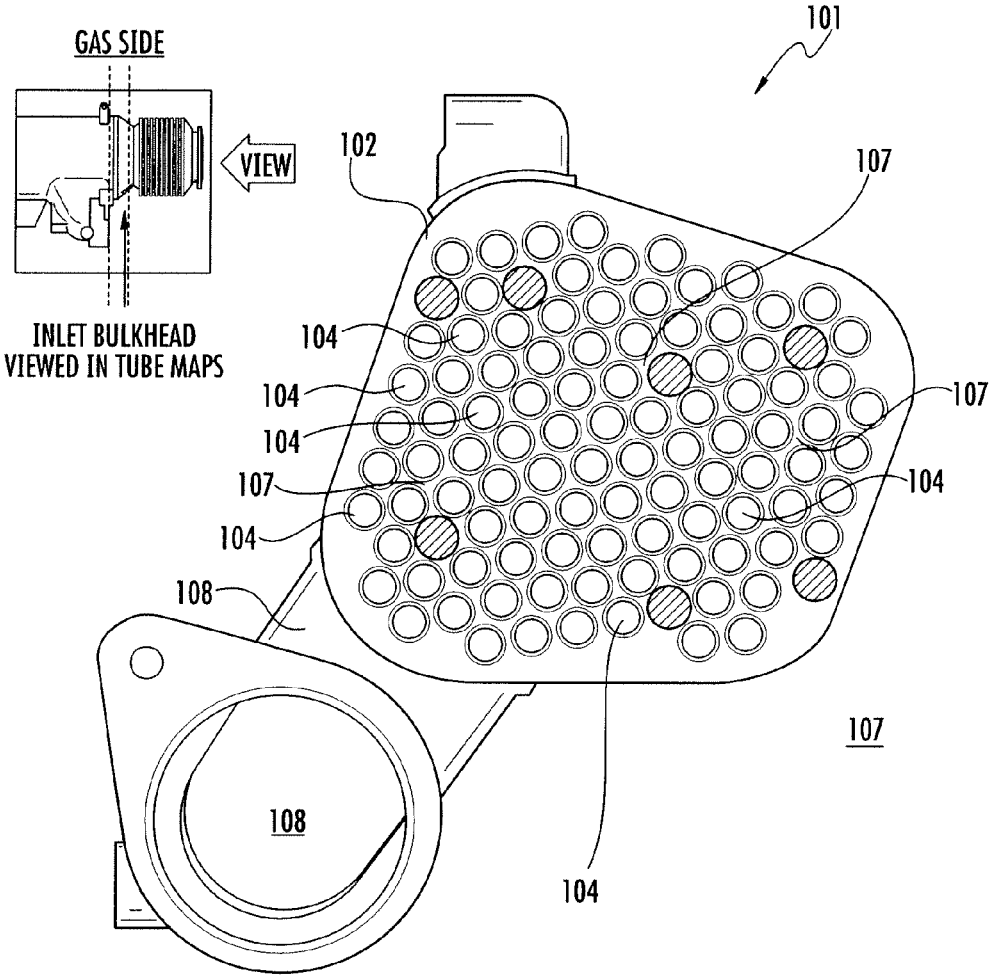
FIG. 2 illustrates an end view of the exhaust gas cooler of FIG. 1 across the exhaust gas cooler.

FIG. 2 illustrates an end view of the cooling system of FIG. 1 across the exhaust gas cooler. As shown in FIG. 2, the exhaust gas cooler 101 houses the plurality of conduits 104 extending longitudinally down the exhaust gas cooler 101. The region 107 is disposed between and about the plurality of conduits 104. The first coolant inlet opening 108 may have a bent or curved conduit for introducing coolant flowing therein to the region 107 via an opening in side wall 114 of the exhaust gas cooler 101. The first coolant inlet opening 108 may include an inflow coolant conduit 116, which may include a flanged coupling.

Figure 3:
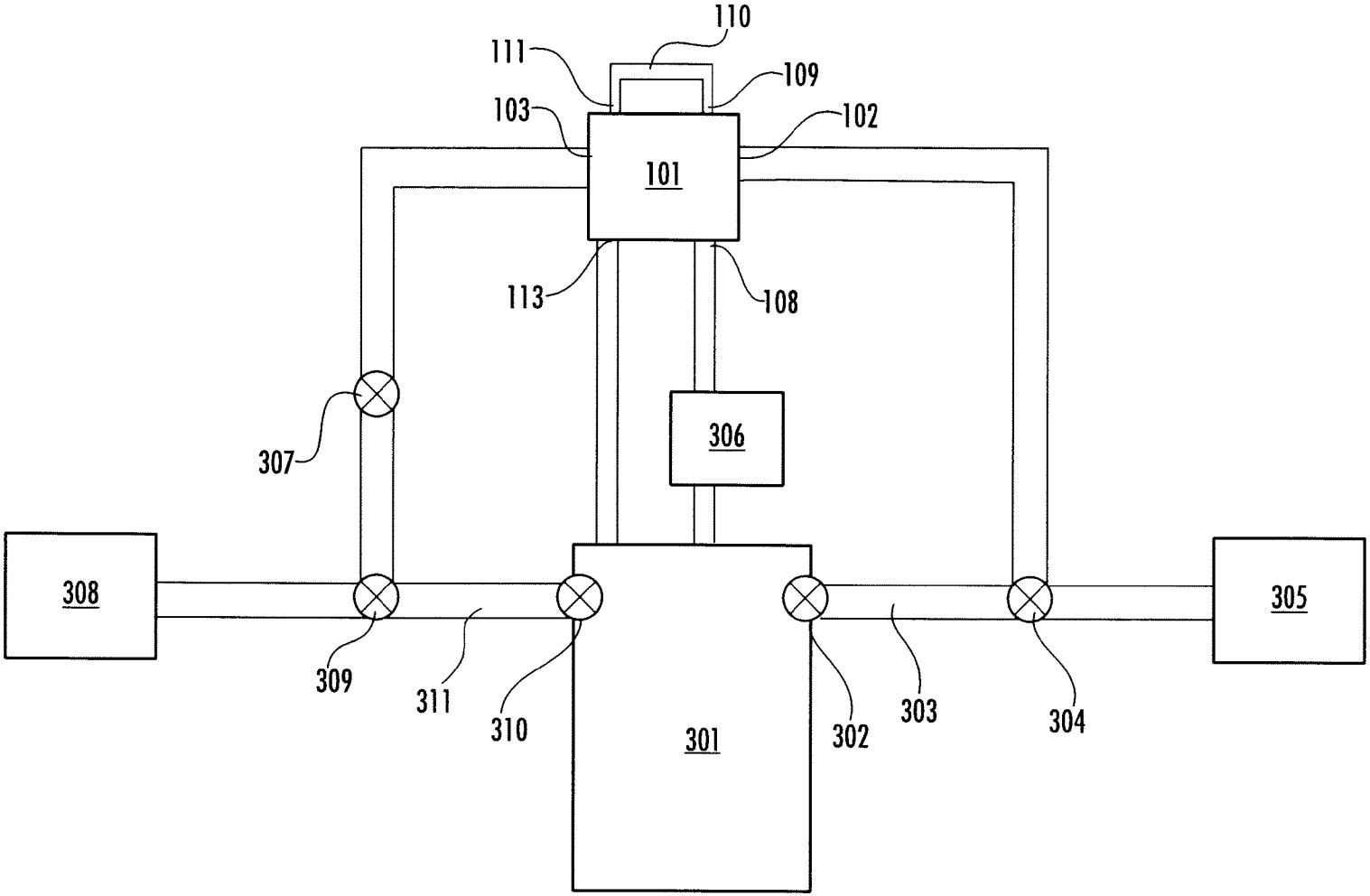
FIG. 3 provides a schematic of the exhaust gas cooler of FIG. 1 implemented with an internal combustion engine, in accordance with example embodiments.

FIG. 3 provides a schematic of the cooling system of FIG. 1 implemented with an internal combustion engine, in accordance with example embodiments. As shown in FIG. 3, a cooling system 100 is positioned to receive exhaust gas for recirculation into an engine 301. As the engine 301 is running, exhaust gas is expelled from one or more cylinders of the engine via an exhaust valve 302. The exhaust valve 302 releases the exhaust to an exhaust manifold 303. The exhaust manifold 303 is in fluid communication with the EGR inlet manifold 102 of the exhaust gas cooler 101. The exhaust pipes extending from the exhaust manifold may include one or more valves 304 controllable to meter all or a portion of the exhaust gas to the exhaust gas cooler 101 and all or a portion of the exhaust gas to the exhaust components 305 for expelling to the atmosphere. The exhaust components 305 may include one or more after-treatment systems, mufflers, or other exhaust components. The exhaust gas entering the exhaust gas cooler 101 is cooled as discussed herein before exiting via the EGR outlet manifold 103. Coolant may be introduced into the exhaust gas cooler 101 via coolant pump 306 pumping coolant into the exhaust gas cooler 101 via the first coolant inlet opening 108 before the warmed coolant exits the exhaust gas cooler 101 via the second coolant outlet opening 113 for transmission back to an engine cooling system. The cooled exhaust gas exiting the exhaust gas cooler 101 via the EGR outlet manifold 103 may be metered for introduction back into engine via an EGR valve 307 in fluid communication with the EGR outlet manifold 103. The EGR valve 307 permits EGR to be combined with air received via an air intake 308 receiving intake air from the atmosphere via throttle 309. Accordingly, the combined EGR and intake air are received in the engine via intake manifold 311 and intake valve 310 for combustion in a cylinder of the engine 301. In example embodiments, engine 301 may include a diesel engine, a turbo-diesel engine, a gasoline engine or variations of the same.

As utilized herein, the terms "approximately," "about," "substantially" and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described without restricting the scope of these features to the precise numerical ranges provided. Accordingly, these terms should be interpreted as indicating that insubstantial or inconsequential modifications or alterations of the subject matter described and are considered to be within the scope of the disclosure.

For the purpose of this disclosure, the term "coupled" means the joining of two members directly or indirectly to one another. Such joining may be stationary or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It should be noted that the orientation of various elements may differ according to other exemplary embodiments, and that such variations are intended to be encompassed by the present disclosure. It is recognized that features of the disclosed embodiments can be incorporated into other disclosed embodiments.

It is important to note that the constructions and arrangements of apparatuses or the components thereof as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

While various inventive embodiments have been described and illustrated herein, those of ordinary skill in the art will readily envision a variety of other mechanisms and/or structures for performing the function and/or obtaining the results and/or one or more of the advantages described herein, and each of such variations and/or modifications is deemed to be within the scope of the inventive embodiments described herein. More generally, those skilled in the art will readily appreciate that, unless otherwise noted, any parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, the technology described herein may be embodied as a method, of which at least one example has been provided. The acts performed as part of the method may be ordered in any suitable way unless otherwise specifically noted. Accordingly, embodiments may be constructed in which acts are performed in an order different than illustrated, which may include performing some acts simultaneously, even though shown as sequential acts in illustrative embodiments.

The indefinite articles "a" and "an," as used herein in the specification and in the claims, unless clearly indicated to the contrary, should be understood to mean "at least one." As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of" will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to.

The claims should not be read as limited to the described order or elements unless stated to that effect. It should be understood that various changes in form and detail may be made by one of ordinary skill in the art without departing from the spirit and scope of the appended claims. All embodiments that come within the spirit and scope of the following claims and equivalents thereto are claimed.

The invention claimed is:

1. An exhaust gas cooler for cooling recirculating exhaust gas, the exhaust gas cooler comprising:

an inlet manifold positioned at a first end of the exhaust gas cooler, the inlet manifold including a plurality of exhaust gas inlet openings;

an outlet manifold positioned at a second end of the exhaust gas cooler, the outlet manifold including a plurality of exhaust gas outlet openings;

a plurality of conduits coupled to the inlet manifold and the outlet manifold, each conduit in the plurality of conduits extending from an exhaust gas inlet opening of the plurality of exhaust gas inlet openings in the inlet manifold to an exhaust gas outlet opening of the plurality of exhaust gas outlet openings in the outlet manifold;

at least one side wall coupled to the outlet manifold and the inlet manifold around the plurality of conduits such that the plurality of conduits are disposed in a region between the at least one side wall, the inlet manifold and the outlet manifold, the at least one sidewall including:

a first coolant inlet opening adjacent the first end of the exhaust gas cooler, a first coolant outlet opening adjacent the first end of the exhaust gas cooler, a second coolant inlet opening, and a second coolant outlet opening; and a bypass conduit positioned outside of the region, the bypass conduit fluidly coupling the first coolant outlet opening to the second coolant inlet opening, such that at least a part of a coolant flowing into the region adjacent the first end of the exhaust gas cooler and between the plurality of conduits flows out of the region adjacent the first end via the first coolant outlet opening, through the bypass conduit, and back into the region via the second coolant inlet opening.

2. The exhaust gas cooler of claim 1, wherein the first coolant inlet opening is substantially opposite the first coolant outlet opening.

3. The exhaust gas cooler of claim 1, wherein the first end is substantially opposite the second end.

4. The exhaust gas cooler of claim 1, wherein the second coolant inlet opening in the side wall is adjacent the second end.

5. The exhaust gas cooler of claim 1, wherein the second coolant outlet opening in the side wall is adjacent the second end.

6. The exhaust gas cooler of claim 1, wherein each conduit in the plurality of conduits is substantially parallel the other conduits in the plurality of conduits.

7. The exhaust gas cooler of claim 6, wherein the bypass conduit is configured to provide a coolant flow path substantially parallel to the plurality of conduits.

8. The exhaust gas cooler of claim 1, wherein the second coolant inlet opening is substantially opposite the second coolant outlet opening.

9. The exhaust gas cooler of claim 1, wherein the inlet manifold includes a first flange and the outlet manifold include a second flange.

10. The exhaust gas cooler of claim 1, further comprising a vent positioned in the bypass conduit.

11. The exhaust gas cooler of claim 1, wherein the first coolant outlet opening is directly coupled to the second coolant inlet opening via the bypass conduit.

12. The exhaust gas cooler of claim 1, wherein the first coolant inlet opening and the first coolant outlet opening are substantially orthogonal to the plurality of conduits.

13. The exhaust gas cooler of claim 1, further comprising a first coolant conduit outside of the region and fluidly coupled to the first coolant inlet opening and second coolant conduit outside of the region and fluidly coupled to the second coolant outlet.

14. The exhaust gas cooler of claim 1, wherein the bypass conduit is configured to bypass at least 25% of the coolant flowing into the first coolant inlet.

15. The exhaust gas cooler of claim 1, wherein each conduit in the plurality of conduits extends into the exhaust inlet opening of the plurality of exhaust inlet openings and into the exhaust outlet opening of the plurality of exhaust outlet openings.

16. The exhaust gas cooler of claim 1, wherein each conduit in the plurality of conduits extends through the exhaust inlet opening of the plurality of exhaust inlet openings and through the exhaust outlet opening of the plurality of exhaust outlet openings.

17. The exhaust gas cooler of claim 1, wherein each conduit in the plurality of conduits extend into the exhaust inlet opening of the plurality of exhaust inlet openings and into the exhaust outlet opening of the plurality of exhaust outlet openings.

18. A method of cooling recirculating exhaust gas via an exhaust gas cooler, the method comprising:

causing exhaust gas to flow into an inlet manifold positioned at a first end of the exhaust gas cooler and out of an outlet manifold positioned at a second end of the exhaust gas cooler, the exhaust gas transmitted from the inlet manifold to the outlet manifold via a plurality of conduits coupled to the inlet manifold and the outlet manifold, each conduit in the plurality of conduits extending from an exhaust gas inlet opening of the plurality of exhaust gas inlet openings in the inlet manifold to an exhaust gas outlet opening of the plurality of exhaust gas outlet openings in the outlet manifold;

causing coolant to flow into a region between at least one side wall coupled to the outlet manifold and the inlet manifold around the plurality of conduits, the coolant flowing into the region via a first coolant inlet opening in the at least one side wall, the first coolant inlet opening adjacent the first end of the exhaust gas cooler;

causing at least a portion of the coolant to flow out of the region via a first coolant outlet opening adjacent the first end of the exhaust gas cooler;

causing the at least a portion of the coolant to flow back into the region via a bypass conduit fluidly coupling the first coolant outlet opening to a second coolant inlet opening in the at least one side wall; and causing the coolant to flow out of the region via a second coolant outlet opening in the at least one side wall, whereby heat is convectively transferred from exhaust gas flowing through the plurality of conduits to coolant flowing through the region.

19. The method of claim 18 further comprising causing gas to vent from the bypass conduit via a vent disposed therein.

20. The method of claim 19, wherein the first coolant outlet opening is directly coupled to the second coolant inlet opening via the bypass conduit.

21. An engine system for cooling recirculating exhaust gas, the engine system comprising:

an engine;

an exhaust manifold configured to receive exhaust from at least one cylinder of the engine;

an exhaust gas cooler including:

an inlet manifold positioned at a first end of the exhaust gas cooler, the inlet manifold including a plurality of exhaust gas inlet openings;

an outlet manifold positioned at a second end of the exhaust gas cooler, the outlet manifold including a plurality of exhaust gas outlet openings;

a plurality of conduits coupled to the inlet manifold and the outlet manifold, each conduit in the plurality of conduits extending from an exhaust gas inlet opening of the plurality of exhaust gas inlet openings to an exhaust gas outlet opening of the plurality of exhaust gas outlet openings;

at least one side wall coupled to the outlet manifold and the inlet manifold around the plurality of conduits such that the plurality of conduits are disposed in a region between the at least one side wall, the inlet manifold and the outlet manifold, the at least one sidewall including:

a first coolant inlet opening adjacent the first end of the exhaust gas cooler, a first coolant outlet opening adjacent the first end of the exhaust gas cooler, a second coolant inlet opening, and a second coolant outlet opening; and a bypass conduit positioned outside of the region, the bypass conduit fluidly coupling the first coolant outlet opening to the second coolant inlet opening, such that at least a part of a coolant flowing into the region adjacent the first end of the exhaust gas cooler and between the plurality of conduits flows out of the region adjacent the first end via the first coolant outlet opening, through the bypass conduit, and back into the region via the second coolant inlet opening; and an intake manifold configured to provide intake air into the at least one cylinder, wherein the exhaust gas cooler is coupled to the exhaust manifold via the inlet manifold of the exhaust gas cooler and wherein exhaust gas cooler is coupled to the intake manifold via the outlet manifold of the exhaust gas cooler.

22. The engine system according to claim 21, wherein the first coolant inlet opening is substantially opposite the first coolant outlet opening.

23. The engine system according to claim 21, wherein the first coolant outlet opening is directly coupled to the second coolant inlet opening via the bypass conduit.

24. The engine system according to claim 21, wherein the second coolant inlet opening in the side wall is adjacent the second end.

25. The engine system according to claim 22, wherein the bypass conduit is configured to provide a coolant flow path substantially parallel to the plurality of conduits.

26. The engine system according to claim 22, wherein the second coolant inlet opening is substantially opposite the second coolant outlet opening.

27. The engine system according to claim 22, further comprising a vent positioned in the bypass conduit.

28. The engine system according to claim 22, wherein the bypass conduit is configured to bypass at least 25% of the coolant flowing into the first coolant inlet.

29. An exhaust gas cooler for cooling recirculating exhaust gas, the exhaust gas cooler comprising:

exhaust gas flow means for causing exhaust gas to flow into an inlet manifold at a first end of the exhaust gas cooler and out of an outlet manifold at a second end of the exhaust gas cooler, the exhaust gas flow means further configured for transmitting the exhaust gas from the inlet manifold to the outlet manifold in a plurality of distinct flow paths;

at least one side wall coupled to the outlet manifold and the inlet manifold about the plurality of distinct flow paths;

coolant flow entry means for causing coolant to flow into a region within the at least one side wall adjacent the first end of the exhaust gas cooler;

bypass means for causing at least a portion of the coolant to flow out of the region adjacent the first end of the exhaust gas cooler and for causing the at least a portion of the coolant to flow back into the region; and coolant flow exit means for causing the coolant to flow out of the region, whereby heat is convectively transferred from exhaust gas in the plurality of distinct flow paths to coolant flowing into and out of the region.

* * * * *